US012104476B1

(12) United States Patent
Xia et al.

(10) Patent No.: US 12,104,476 B1
(45) Date of Patent: Oct. 1, 2024

(54) METHOD TO IDENTIFY PERFORATION LOCATIONS FOR FRACTURING DEEP AND TIGHT SANDSTONE RESERVOIR

(71) Applicant: SAUDI ARABIAN OIL COMPANY, Dhahran (SA)

(72) Inventors: Kaiming Xia, Dhahran (SA); Weihua Wang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/304,031

(22) Filed: Apr. 20, 2023

(51) Int. Cl.

| | |
|---|---|
| ***E21B 49/00*** | (2006.01) |
| ***E21B 43/116*** | (2006.01) |
| ***E21B 43/119*** | (2006.01) |
| ***E21B 43/26*** | (2006.01) |

(52) U.S. Cl.
CPC ..... *E21B 43/26* (2013.01); *E21B 43/116* (2013.01); *E21B 43/119* (2013.01); *E21B 49/006* (2013.01)

(58) Field of Classification Search
CPC ..... E21B 49/006; E21B 43/119; E21B 43/26
See application file for complete search history.

(56) References Cited

U.S. PATENT DOCUMENTS 8,126,689 B2 * 2/2012 Soliman ..... E21B 43/26 703/2
8,733,444 B2 * 5/2014 East, Jr. ..... E21B 43/26 166/250.1
10,422,207 B2 * 9/2019 Aidagulov ..... E21B 43/26
10,526,890 B2 * 1/2020 Batmaz ..... E21B 43/27
10,711,604 B2 * 7/2020 Johnson ..... E21B 43/267
11,255,184 B1 2/2022 Xia et al.
11,391,135 B1 7/2022 Xia et al.
11,873,709 B2 * 1/2024 Wang ..... G01N 33/241
(Continued)

OTHER PUBLICATIONS

Kurdi M. et al.; "A New Computational Model to Predict Breakdown Pressures in Cased and Perforated Wells in Unconventional Reservoirs", AEGC Extended Abstracts, 2018: Sydney, Austrailia (10 pages).

(Continued)

*Primary Examiner* — Kenneth L Thompson
(74) *Attorney, Agent, or Firm* — Osha Bergman Watanabe & Burton LLP

(57) ABSTRACT

A method includes gathering data about the well and the deep and tight sandstone reservoir, evaluating a diagenetic rock typing and a flow index of the reservoir using the data, and determining a first set of perforation locations based on the diagenetic rock typing and the flow index. The method also includes calibrating in-situ stresses based on the data and determining a breakdown pressure envelope and optimal perforation directions using the in-situ stresses, maximum horizontal stress direction, formation mechanical properties, and well trajectory. The method further includes narrowing the first set of perforation locations to a second set of perforation locations based on the breakdown pressure envelope, comparing the breakdown pressure envelope of the second set of perforation locations to a maximum downhole pressure to determine a perforation method, and performing a fracturing operation on the well using the second set of perforation locations, the perforation method, and the optimal perforation directions.

20 Claims, 8 Drawing Sheets

(56) References Cited

U.S. PATENT DOCUMENTS

| | | | |
|---|---|---|---|
| 2015/0176387 | A1 | 6/2015 | Wutherich |
| 2020/0284136 | A1 | 9/2020 | Grove et al. |
| 2022/0106866 | A1 | 4/2022 | Wang et al. |
| 2023/0064121 | A1 | 3/2023 | Xia et al. |

OTHER PUBLICATIONS

Al-Ameri, N.J.; "Perforation location optimization through 1-D mechanical earth model for high-pressure deep formations", Journal of Petroleum Exploration and Production Technology, 2021, vol. 11, pp. 4243-4252 (10 pages).

Johnson, R.L. et al.; "Well Trajectory, Completion and Fracture Design Changes Improve Execution for Deep Unconventional Tight Gas Targets in the Cooper Basin, Australia", SPE-194366-MS, (20 pages).

* cited by examiner 300 302 304 306

| Diagenetic Rock Type | Code | Effective Porosity | Clay Content |
|---|---|---|---|
| Type 1 | 6 | >5% | <5% |
| Type 2 | 5 | >5% | =>5% |
| Type 3 | 4 | 3%<= =<5% | <10% |
| Type 4 | 3 | 3%<= =<5% | =>10% |
| Type 5 | 2 | <3% | <20% |
| Type 6 | 1 | <3% | =>20% |

FIG. 3

METHOD TO IDENTIFY PERFORATION LOCATIONS FOR FRACTURING DEEP AND TIGHT SANDSTONE RESERVOIR

BACKGROUND

Hydrocarbons are located in porous rock formations far beneath the Earth's surface. Wells are drilled into these formations to access and produce the hydrocarbons. Some hydrocarbon bearing formations have a low permeability meaning that the formation must be stimulated to economically produce the hydrocarbons from the formation.

Hydraulic fracturing is a stimulation method that uses highly pressurized fluids to fracture the formation and increase the formation drainage areas. In order to fracture the formation, the cemented casing string in the well should be perforated to create a hydraulic conduit from the well to the formation. After the perforations are created, the fluid is pumped into the well. The downhole hole fluid pressure is increased until it surpasses the pressure required to break down the formation. Once the downhole fluid pressure surpasses the breakdown pressure of the formation, fractures are initiated from the perforation cluster and propagated along the direction of maximum horizontal stress in the formation. However, fracturing operations frequently face breakdown issues, which may cause premature operation termination.

SUMMARY

This summary is provided to introduce a selection of methods that are further described below in the detailed description. This summary is not intended to identify key or essential features of the claimed subject matter, nor is it intended to be used as an aid in limiting the scope of the claimed subject matter.

This disclosure presents, in accordance with one or more embodiments, methods and systems for fracturing a well that is drilled through a deep and tight sandstone reservoir and has a wellhead. Various steps within the method are performed using a computer processor. Embodiments of the method include gathering data about the well and the deep and tight sandstone reservoir, evaluating a diagenetic rock typing and a flow index of the deep and tight sandstone reservoir using the data, and determining a first set of perforation locations based on the diagenetic rock typing and the flow index. The method also includes calibrating in-situ stresses based on the data and determining a breakdown pressure envelope and optimal perforation directions using the in-situ stresses, maximum horizontal stress direction, formation mechanical properties, and well trajectory. The method further includes narrowing the first set of perforation locations to a second set of perforation locations based on the breakdown pressure envelope and comparing the breakdown pressure envelope of the second set of perforation locations to a maximum downhole pressure to determine a perforation method. The maximum downhole pressure the wellhead can safely provide is based on a safety limit capacity of the wellhead. The method also includes performing a fracturing operation on the well using the second set of perforation locations, the perforation method, and the optimal perforation directions (perforation azimuth and phase angles).

Embodiments of the system include a hydraulic fracturing system having perforating and pumping equipment. The hydraulic fracturing system is configured to perform a hydraulic fracturing operation using a perforating gun to perforate the well and a frac fluid pumped to fracture the deep and tight sandstone reservoir. The system further comprises a computer processor configured to perform the method as outlined above.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

FIG. 3 shows a table of the diagenetic rock types in accordance with one or more embodiments.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
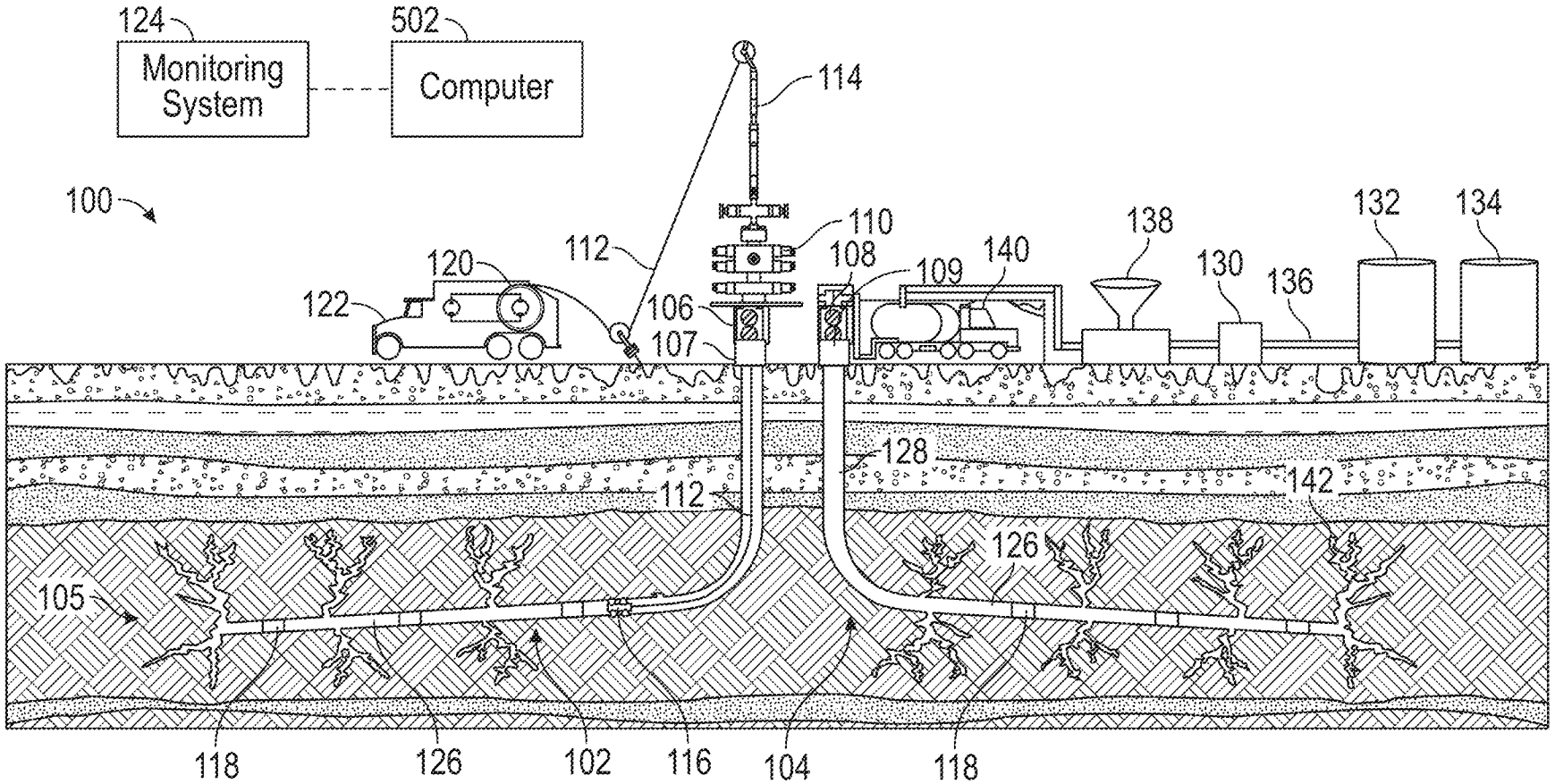
FIG. 1 shows a hydraulic fracturing system undergoing a hydraulic fracturing operation in accordance with one or more embodiments.

FIG. 1 shows a hydraulic fracturing system (100) undergoing a hydraulic fracturing operation in accordance with one or more embodiments. The particular hydraulic fracturing operation and hydraulic fracturing system (100) shown is for illustration purposes only. The scope of this disclosure is intended to encompass any type of hydraulic fracturing system (100) and hydraulic fracturing operation. In general, a hydraulic fracturing operation includes two separate operations: a perforation operation and a pumping operation.

In further embodiments, a hydraulic fracturing operation is performed in stages and on multiple wells that are geographically grouped. A singular well may have anywhere from one to more than forty stages. Typically, each stage includes one perforation operation and one pumping operation. While one operation is occurring on one well, a second operation may be performed on the other well. As such, FIG. 1 shows a hydraulic fracturing operation occurring on a first well (102) and a second well (104). The first well (102) is undergoing the perforation operation and the second well (104) is undergoing the pumping operation.

The first well (102) and the second well (104) are horizontal wells meaning that each well includes a vertical section and a lateral section. The lateral section is a section of the well that is drilled at least eighty degrees from vertical. However, this disclosure is not meant to be limiting to a horizontal well and any well orientation (horizontal, vertical, deviated, etc.) may be used herein. The first well (102) and the second well (104) are drilled into a reservoir (105). The reservoir (105) is a porous formation that may contain hydrocarbons or other fluids that may be desired to be produced.

The first well (102) is capped by a first wellhead (107) and the second well (104) is capped by a second wellhead (109). A wellhead (107, 109) is the portion of the well (102, 104) that houses the surface extending portion of downhole tubulars, such as casing (126) strings. The wellhead (107, 109) includes spools and valves that are used to access the well (107, 109). In accordance with one or more embodiments, the wellhead (107, 109) is the conduit through which most downhole operations are performed through. The wellhead (107, 109) may also be the device that equipment is connected to in order to perform operations on the well (102, 104).

In a hydraulic fracturing operation, a first frac tree (106) is connected to the first wellhead (107) and a second frac tree (108) is connected to the second wellhead (109). A frac tree (106, 108) is similar to a Christmas/production tree, but is specifically installed for the hydraulic fracturing operation. Frac trees (106, 108) tend to have larger bores and higher-pressure ratings than a Christmas/production tree would have. Further, hydraulic fracturing operations require proppant laden fluids pumped into the well at high pressures, so the frac tree (106, 108) is designed to handle a higher rate of erosion.

In accordance with one or more embodiments, the first well (102) and the second well (104) each require four stages. Both the first well (102) and the second well (104) have undergone three stages and are shown undergoing the fourth stage. The second well (104) has already undergone the fourth stage perforation operation and is currently undergoing the fourth stage pumping operation. The first well (102) is undergoing the fourth stage perforating operation and has yet to undergo the fourth stage pumping operation.

In accordance with one or more embodiments, the perforating operation includes installing a wireline blow out preventor (BOP) (110) onto the first frac tree (106). A wireline BOP (110) is similar to a drilling BOP; however, a wireline BOP (110) has seals designed to close around (or shear) wireline (112) rather than drill pipe. A lubricator (114) is connected to the opposite end of the wireline BOP (110). A lubricator (114) is a long, high-pressure pipe used to equalize between downhole pressure and atmosphere pressure in order to run downhole tools, such as a perforating gun (116), into the well.

The perforating gun (116) is pumped into the first well (102) using the lubricator (114), wireline (112), and fluid pressure. In accordance with one or more embodiments, the perforating gun (116) is equipped with explosives and a frac plug (118) prior to being deployed in the first well (102). The wireline (112) is connected to a spool (120) often located on a wireline truck (122). Electronics (not pictured) included in the wireline truck (122) are used to control the unspooling/spooling of the wireline (112) and are used to send and receive messages along the wireline (112).

The electronics may also be connected, wired or wirelessly, to a monitoring system (124) that is used to monitor and control the various operations being performed on the hydraulic fracturing system (100). In accordance with one or more embodiments, the monitoring system (124) is connected to or integrated with a computer (702) system. The computer (702) system is further outlined in FIG. 7.

When the perforating gun (116) reaches a predetermined depth, a message is sent through the wireline (112) to detonate the explosives, as shown in FIG. 1. The explosives create perforations penetrating through the cemented casing (126) into the surrounding reservoir (105). There may be more than one set of explosives on a singular perforation gun (116), each detonated by a distinct message. In accordance with one or more embodiments, multiple sets of explosives, called perforation clusters, are used to perforate at different depths along the cemented casing (126) for a singular stage. In accordance with one or more embodiments and after the explosives are detonated, another message is sent along the wireline (112) to set the frac plug (118). The frac plug (118) is used to create a barrier between frac stages and aid in well control. In alternative embodiments, the frac plug (118) may be set separately from the perforation operation without departing from the scope of the disclosure herein.

As explained above, FIG. 1 shows the second well (104) undergoing the pumping operation after the fourth stage perforating operation has already been performed and perforations are left behind in the casing (126) and the surrounding reservoir (105). A pumping operation includes pumping a frac fluid (128) into the perforations in order to propagate the perforations and create fractures (142) in the surrounding reservoir (105). The frac fluid (128) often comprises a certain percentage of water, proppant, and chemicals.

FIG. 1 shows chemical storage containers (130), water storage containers (132), and proppant storage containers (134) located on the hydraulic fracturing system (100). Frac lines (136) and transport belts (not pictured) transport the chemicals, proppant, and water from the storage containers (130, 132, 134) into a frac blender (138). A plurality of sensors (not pictured) are located throughout this equipment to send signals to the monitoring system (124). The monitoring system (124) may be used to control the volume of water, chemicals, and proppant used in the pumping operation.

The frac blender (138) blends the water, chemicals, and proppant to become the frac fluid (128). The frac fluid (128) is transported to one or more frac pumps, often pump trucks (140), to be pumped through the second frac tree (108) into the second well (104). Each pump truck (140) includes a pump designed to pump the frac fluid (128) at a certain pressure. More than one pump truck (140) may be used at a time to increase the pressure of the frac fluid (128) being pumped into the second well (104). The frac fluid (128) is transported from the pump truck (140) to the second frac tree (108) using a plurality of frac lines (136).

The fluid pressure propagates and creates the fractures (142) while the proppant props the fractures (142) once the pressure is released. Different chemicals may be used to lower friction pressure, prevent corrosion, etc. The pumping operation may be designed to last a certain length of time to ensure the fractures (142) have propagated enough and generate a desired fracture geometry. Further the frac fluid (128) may have different make ups throughout the pumping operation to optimize the pumping operation without departing from the scope of the disclosure herein.

Selecting optimal locations for the perforation clusters along the cemented casing (126) of the well (102, 104) is important because the perforations are the points along the cemented casing (126) that allow the frac fluid (128) to access the reservoir (105) to create the fractures (142). For fracturing deep and tight sandstone reservoirs, the locations of the perforation clusters should be strategically selected in order to reduce the breakdown pressure required to initiate the fractures (142) and ensure the fractures (142) propagate into the most economic portions of the reservoir (105) as well as the most easily fractured portions of the reservoir (105). As such, embodiments outlined herein disclose systems and methods that select optimal perforation cluster locations in a well using diagenetic rock typing, flow indexes, and required breakdown pressure envelopes.

In accordance with one or more embodiments, the well may be any type of well drilled through a reservoir (105) and having a wellhead (107, 109). As such, the well may have any orientation, trajectory, wellbore schematic, etc. without departing from the scope of the disclosure herein. Embodiments disclosed herein are outlined using the wells (102, 104) shown in FIG. 1 as an example, but the embodiments are not meant to be limited to the exact specifications of the wells (102, 104) as described in FIG. 1.

The reservoir (105) may be any type of porous rock formation that has the potential to contain a fluid, such as hydrocarbons. In accordance with one or more embodiments, the reservoir (105) may be a deep and tight sandstone reservoir (105) containing gas hydrocarbons. In accordance with one or more embodiments, tight sandstones are characterized by low permeability and porosity due to heavy compaction and various diagenetic minerals cementation through the geological time.

The reservoir (105) quality, i.e., porosity and permeability, is the reflection of initial sediment composition and subsequent diagenetic modifications. Diagenesis refers to the physical and chemical process that occurs from deposition and continues through compaction, cementation, and dissolution. In accordance with one or more embodiments, diagenesis is determined based on data obtained from core samples of the reservoir (105).

A hydraulic fracturing operation, such as the operation outlined in FIG. 1, may be used to stimulate deep and tight sandstone gas reservoirs (105) when the reservoirs (105) are unable to be produced naturally. In accordance with one or more embodiments, a deep reservoir (105) is a reservoir that is between 12,000-20,000 feet below the surface of the Earth. A tight reservoir (105) is a reservoir characterized by low permeability, large pressure gradient across reservoir, often layered and complex, high transient decline rate, and comingled production. Typical lithology of tight reservoirs are sandstone/siltstone and rarely carbonate with permeability as low as less than 0.1 mD (millidarcy).

For wells (102, 104) landed in the deep and tight sandstone reservoirs (105), the fracture (142) initiation generally requires a high breakdown pressure. In this scenario, identifying ideal perforation cluster locations along the cemented casing (126) of the well (102, 104) is critical to the success of the hydraulic fracturing operation because the wellhead (107, 109) of the well (102, 104) is rated to a certain pressure safety limit that cannot be exceeded during the hydraulic fracturing operation. The fluid injection has to be terminated if the surface treating pressure close to the wellhead safety limit even though the formation breakdown around the perforation cluster has not be achieved.

In further embodiments, the fractures (142) should propagate into good rock typing areas. Good rock typing areas may be portions of the reservoir (105) that have clean sand, low clay content, relative high porosity, and high gas content. The good rock typing areas may be evaluated through petrophysical evaluation and diagenetic rock typing analysis.

As such, embodiments disclosed herein outline methods that may identify ideal perforation cluster locations along the landing portion of the casing (126) of the well (102, 104) after the well (102, 104) is drilled. In accordance with one or more embodiments, embodiments disclosed herein are applicable to vertical, horizontal, or deviated wells that are cemented, cased, and require a clustered-perforation hydraulic fracturing operation. In summary, embodiments disclosed herein combine geomechanics factors and rock diagenetic typing factors together to identify ideal perforation cluster locations that allow fractures (142) to initiate using a lower breakdown pressure but also ensure the fractures (142) propagate into relatively better rock typing areas.

Figure 2:
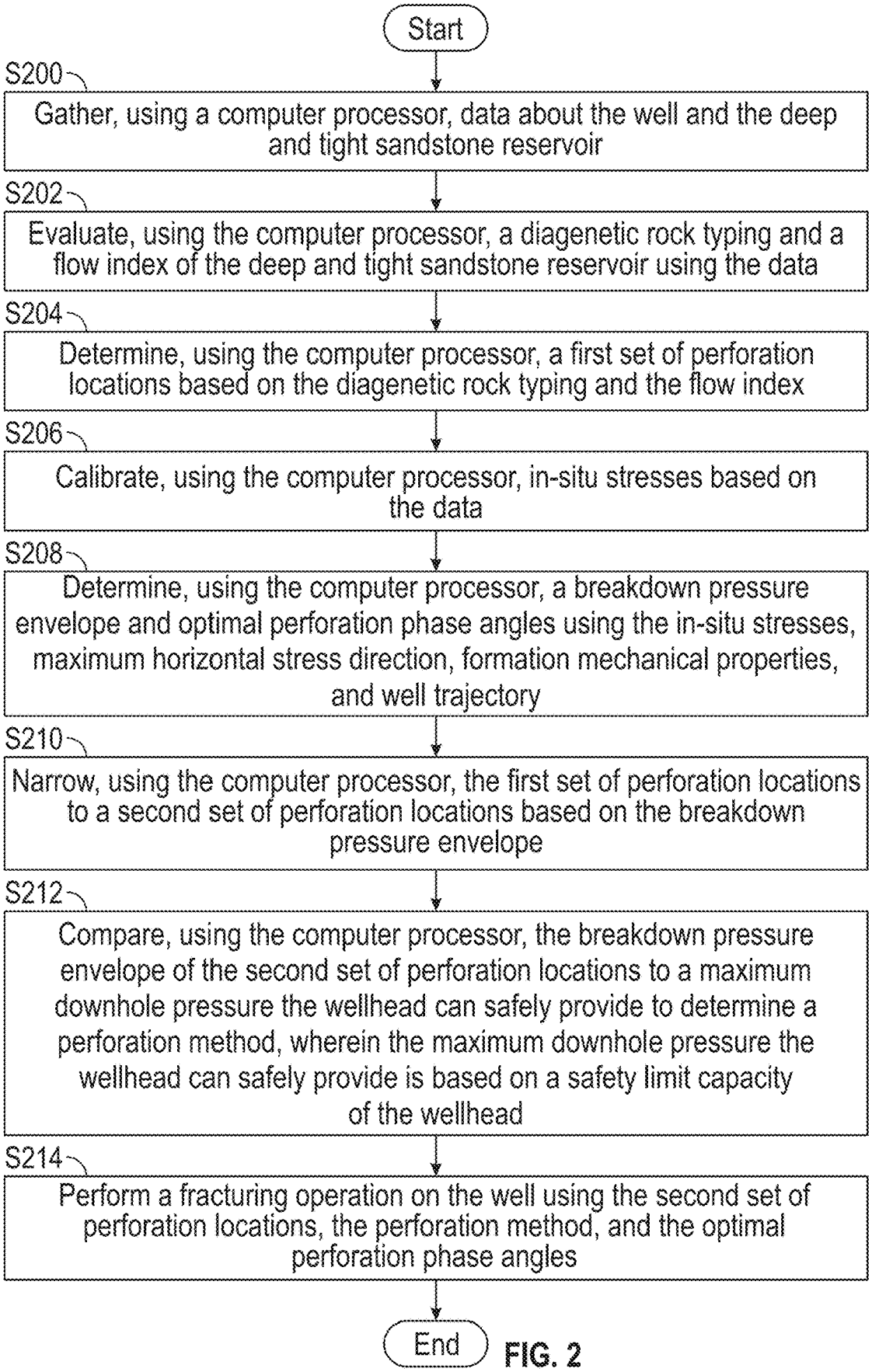
FIG. 2 shows a flowchart in accordance with one or more embodiments.

FIG. 2 shows a flowchart in accordance with one or more embodiments. The flowchart outlines a method for fracturing a well (102, 104) drilled through a reservoir (105) and having a wellhead (107, 109). While the various blocks in FIG. 2 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S200, data about the well (102, 104) and the deep and tight sandstone reservoir (105) is gathered using the computer processor (705). In accordance with one or more embodiments, the data may include well logs, drilling reports, wellbore trajectories, formation tops, reservoir (105) data, etc. In S202, a diagenetic rock typing and a flow index of the deep and tight sandstone reservoir (105) is evaluated using the data and the computer processor (705).

Diagenetic rock typing is one of the components of the disclosed method that may be used to evaluate reservoir (105) rock quality. Diagenetic rock typing includes generating different diagenetic rock types according to effective porosity and total clay content variation. In accordance with one or more embodiments, compaction and cementation are two main diagenetic process which reduce sandstone intergranular porosity and permeability.

Compaction may be a function of burial depth. Thus, heavy compaction may be expected with increased burial depth. High compaction may lead to lower permeability and lower porosity. In accordance with one or more embodiments, cementation may affect the porosity and permeability of a reservoir (105) to a higher degree than compaction. This is because heterogeneity is caused by different types and amounts of cement. For example, quartz cemented clean sandstone has better porosity and permeability than clay cemented sandstones. Therefore, clay content, which may include illite, kaolinite, and chlorite, is used for determining different diagenetic rock types. As such, total clay content may be used as one of the factors when evaluating sandstone diagenetic rock typing.

Tight sandstone reservoirs (105) may be divided into six different type of diagenetic rock types, namely TYPE1 (code:6), TYPE2 (code:5), TYPE3 (code:4), TYPE4 (code: 3), TYPE5 (code:2) and TYPE6 (code:1). FIG. 3 shows a table of the diagenetic rock types in accordance with one or more embodiments. The table shows six diagenetic rock types (300). Each diagenetic rock type (300) is associated with a code (302) and criteria.

The criteria is used to determine which diagenetic rock type (300) a sample of the reservoir (105) may be categorized as. In accordance with one or more embodiments, the criteria includes effective porosity (304) and total clay content (306). The effective porosity (304) and total clay content (306) may be determined based on the well logs and/or core samples of the reservoir (105) at each measured depth. In accordance with one or more embodiments, higher diagenetic rock type codes (302) have better rock quality and will be better for production.

In accordance with one or more embodiments, the diagenetic rock type is determined along the reservoir (105) portion of the well (102, 104) using the effective porosity and total clay content along the reservoir (105) portion of the well (102, 104). The effective porosity and the total clay content may be included in the data from well logs obtained in S200.

Authigenic clay, such as authigenic illite, heavily affect reservoir (105) permeability. As such, the authigenic clay has a large impact on gas flow capacity. The gas flow capacity is determined by calculating the flow index using Equation (1) below.

$$FI = \frac{PHIE}{(a + \text{total clay})} \qquad \text{Equation (1)}$$

FI is the flow index, a is a consistent value, total clay is the total clay content (306) which may be a lump sum of illite, kaolinite, and chlorite, and PHIE is the effective porosity (304). In accordance with one or more embodiments, a curve of the flow index along the portion of the well (102, 104) extending through the reservoir (105) may be developed using Equation (1).

In S204, a first set of perforation locations is determined based on the diagenetic rock typing and the flow index and using the computer processor (705). In particular, the first set of perforation locations may include portions of the well (102, 104) extending through the reservoir (105) that have higher diagenetic rock type codes (302) and high flow indexes. In accordance with one or more embodiments, the first set of perforation locations are numerically one or more measured depths where a perforation cluster may be shot. The perforation cluster may include one or more perforations.

In S206, in-situ stresses are calibrated using the drilling data and the computer processor (705). In accordance with one or more embodiments, the data undergoes image log processing to determine breakouts, natural fractures, and maximum horizontal stress directions of the portion of the reservoir (105) surrounding the well (102, 104). In further embodiments, logging data is used to calculate geomechanical properties of the reservoir (105) surrounding the well (102, 104). In accordance with one or more embodiments, drilling data, the geomechanical properties of the reservoir (105), and the results from the image log processing and drilling data are used to calibrate the in-situ stresses.

In S208, a breakdown pressure envelope and optimal perforation directions are determined using the in-situ stresses, maximum horizontal stress direction, formation mechanical properties, well trajectory, and the computer processor (705). In accordance with one or more embodiments, the breakdown pressure envelope represents the lowest and the highest breakdown pressure at each measured depth, or range of measured depths, of the portion of the well (102, 104) extending through the reservoir (105). In further embodiments, the lowest and the highest breakdown pressures correspond to different perforation phase angles around the well (102, 104). The lowest breakdown pressure and its corresponding directions indicates where and which direction to perforate along the well trajectory. The magnitude of the lowest and highest breakdown pressure at a measured depth indicates the challenging level of breakdown issue. The range between the lowest and highest breakdown pressures at a measured depth indicates benefits and needs of using oriented perforation before hydraulic fracturing fluid injection.

Figure 4:
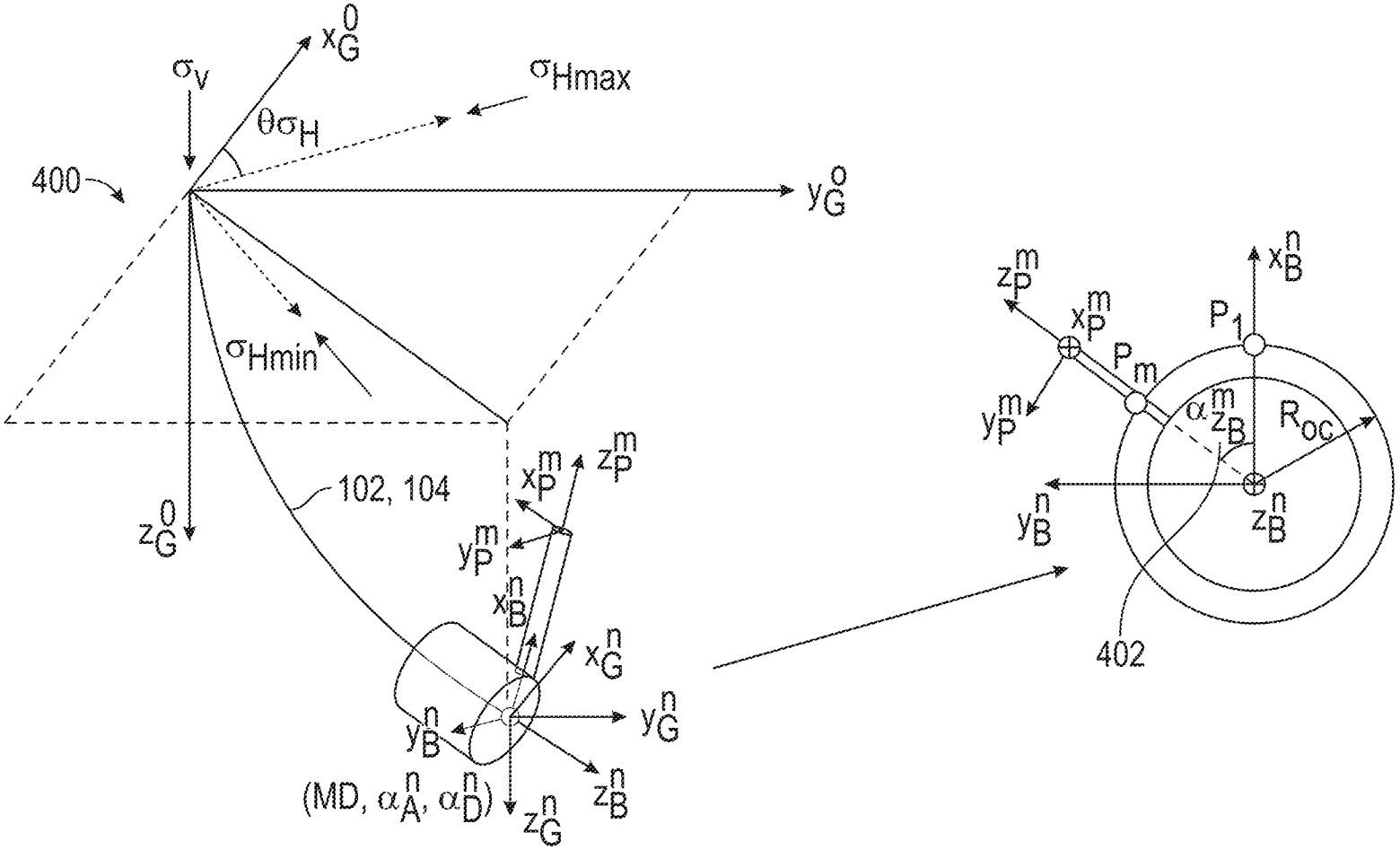
FIG. 4 shows a coordinate system for determining breakdown pressure envelope and optimal perforation directions for clustered-perforation hydraulic fracturing a reservoir in accordance with one or more embodiments.

FIG. 4 shows a series of coordinate systems (400) for determining breakdown pressure and optimal perforation direction of a reservoir (105) in accordance with one or more embodiments. Specifically, FIG. 4 shows an approach applicable to a 3D well trajectory with the various in-situ stresses that are used to determine the corresponding breakdown pressure and optimal perforation directions at each measured depth (402) in relation to the well (102, 104).

For a hydraulic fracturing operation, accurately estimating the breakdown pressure and optimal perforation directions required to fracture wells located in a deep and tight sandstone reservoir (105) is important. In accordance with one or more embodiments, the required breakdown pressure is used to determine the wellhead (107, 109) pressure limit, and design the pump schedules.

In accordance with one or more embodiments, the required breakdown pressure for a perforation cluster is also dependent on the perforation directions. A perforation cluster may include more than one perforation all being shot at different perforation phase angles (402). Thus, for a perforation cluster, there are multiple breakdown pressures as the required breakdown pressure changes for each individual perforation depending on the perforation phase angle (402). The perforation phase angle (402) may range from 0 to 360 degrees. As stated above, the lowest and highest breakdown pressures are determined at each measured depth, or range of measured depths, of the portion of the well (102, 104) extending through the reservoir (105).

The lowest and highest breakdown pressures are used to form the breakdown pressure envelop. The corresponding phase difference between the lowest and highest breakdown pressure may be 90° for an anisotropic stress regime. In accordance with one or more embodiments, the lowest breakdown pressure at each measured depth is the ideal breakdown pressure if the perforation can be fired in that direction. The highest breakdown pressure corresponds to the direction which requires the highest breakdown pressure to initiate a fracture (142) from the cased-hole well (102, 104) at each measured depth. The optimal perforation direction may be given by the perforation azimuth and the perforation phase angle (402).

In S210, the first set of perforation locations are narrowed to a second set of perforation locations based on the breakdown pressure envelope and using the computer processor (705). In accordance with one or more embodiments, one or more perforation locations that have a lower breakdown pressure, when compared to other perforation locations, are selected from the first set of perforation locations to create the second set of perforation locations.

For example, the first set of perforation locations may include all measured depths along the well (102, 104) that have a diagenetic rock type (300) of TYPE1 or TYPE2 and a high flow index. Subsequently, the breakdown pressure envelopes of those perforation locations are analyzed, and the perforation locations that have the comparatively lowest breakdown pressure envelope are selected to form the second set of perforation locations. This is very critical to the success of fracturing deep and tight sandstone reservoirs.

In S212, the breakdown pressure envelope of the second set of perforation locations is compared to a maximum downhole pressure the wellhead (107, 109) can safely provide to determine a perforation method, wherein the maximum downhole pressure the wellhead (107, 109) can safely provide is based on a safety limit capacity of the wellhead (107, 109). In S214, a fracturing operation is performed on the well (102, 104) using the second set of perforation locations, the perforation method, and the optimal perforation directions (perforation azimuth and phase angles).

When performing a hydraulic fracturing operation, two requirements should be met. The first requirement includes keeping the surface treating pressure at the wellhead (107, 109) below the safety limit of the wellhead (107, 109). The second requirement includes ensuring the downhole pressure is above the required breakdown pressure of the perforation clusters. Different-phase perforation tunnel requires different breakdown pressure, which is between the lowest breakdown pressure and largest breakdown pressure at a measured depth shown in the breakdown pressure envelope.

In accordance with one or more embodiments, hydraulic fracturing surface operations should be designed to not surpass the maximum allowable operating pressure of the wellhead safety limit. As such, the breakdown pressure envelope of the second set of perforation locations is compared to the maximum downhole pressure the wellhead can safely provide to ensure a safe pumping operation.

In accordance with one or more embodiments, if the lower boundary of the breakdown pressure envelope of the second set of perforation locations is less than 85 percent of the maximum downhole pressure the wellhead can safely provide, then the wellhead (107, 109) can safely provide the required downhole pressure to break down the rock for fracture initiation and a conventional perforation method may be selected. If the lower boundary of the breakdown pressure envelope of the second set of perforation locations is more than 85 percent of the maximum downhole pressure, then the wellhead (107, 109) may not be able to safely provide the required downhole pressure to break down the rock for fracture initiation and an oriented perforation method should be selected.

Figure 5:
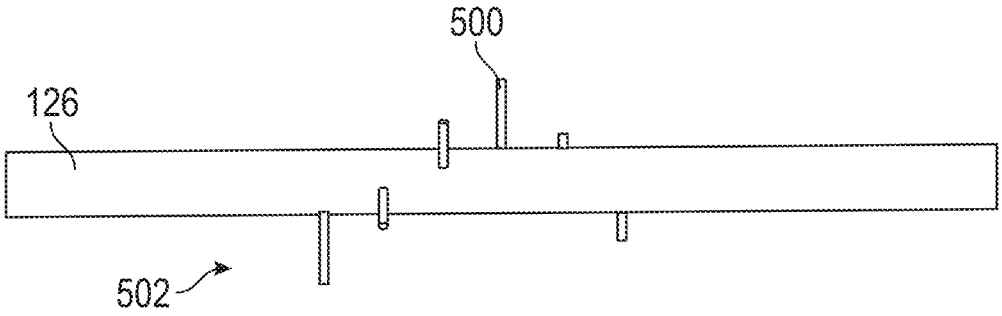
FIG. 5 shows a conventional perforation method in accordance with one or more embodiments.
Figure 6:
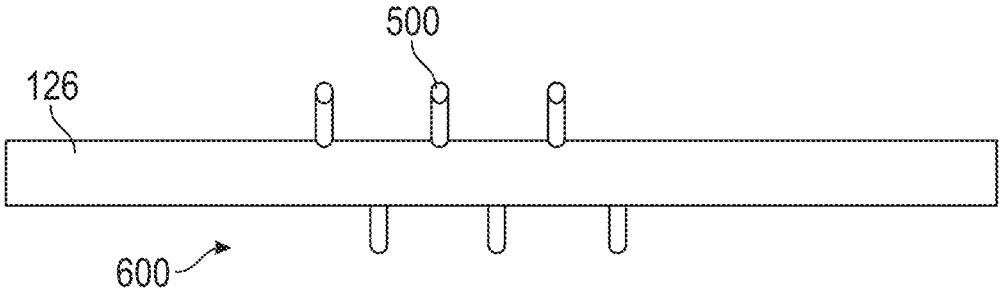
FIG. 6 shows an oriented perforation method in accordance with one or more embodiments.

FIG. 5 shows a conventional perforation method in accordance with one or more embodiments. A conventional perforation method is defined as shown in FIG. 5, which is blindly generated at the targeted measured depth. Therefore, the conventional perforation method has low chance to generate perforation tunnels along the optimal perforation directions. For deep and tight sandstone reservoir, perforation cluster might face breakdown or fracture initiation issue before the surface treating pressure hit the wellhead safety limit. FIG. 6 shows an oriented perforation method in accordance with one or more embodiments. Both FIGS. 5 and 6 show a perforation cluster shot onto a cemented casing (126). The individual perforations (500) are shown. The combined individual perforations (500) create a perforation cluster. FIG. 5 shows a conventional perforation cluster (502) which has perforations fired at different direction. FIG. 6 shows an oriented perforation cluster (600) which has perforations fired at optimum perforation directions.

In accordance with one or more embodiments, the conventional perforation clusters (502) that make up a conventional perforation method each include a plurality of perforations (500) that are shot at equal increments (spiral order) from 0 to 360 degrees around the circumference of the casing (126), as shown in FIG. 5.

In accordance with one or more embodiments, the oriented perforation method includes calculating the optimal perforation direction. The optimal perforation direction includes the perforation azimuths and perforation phase angles (402) that lead to the smallest breakdown pressure envelopes.

For example, assume one of the optimal perforation azimuths is calculated as Perf_AZI, and other one is at the opposite direction Perf_AZI+180° (degrees) based on the mechanics, which means a phase difference of 180° (degrees). For an oriented perforation cluster (600), half of the perforations are shot at the perforation azimuth Perf_AZI, and the second half of the perforations are shot in the opposite direction of Perf_AZI+180° (degrees). Based on solid mechanics, using oriented perforation can initiate hydraulic fractures with the lowest breakdown pressure at a measured depth. This method may further increase the success rate of fracture initiation.

Depending on the well (102, 104) trajectory, the oriented perforation method may vary. For vertical wells, the perforation interval may be relatively large (for example, 5-20 feet). For horizontal wells with large hole deviation, the perforation interval may be relatively small (for example, 2-4 feet). Small perforation intervals may alleviate the near wellbore fracture tortuosity issues after the fractures are initiated. Otherwise, multiple and reoriented nonplanar fractures originating from the perforation cluster may lead to premature screen-out and negatively impact the fluid injection potential to achieve a desired stimulation performance. The oriented perforation for vertical, deviated and horizontal wells should not be dogmatically same in perforation interval.

Figure 7:
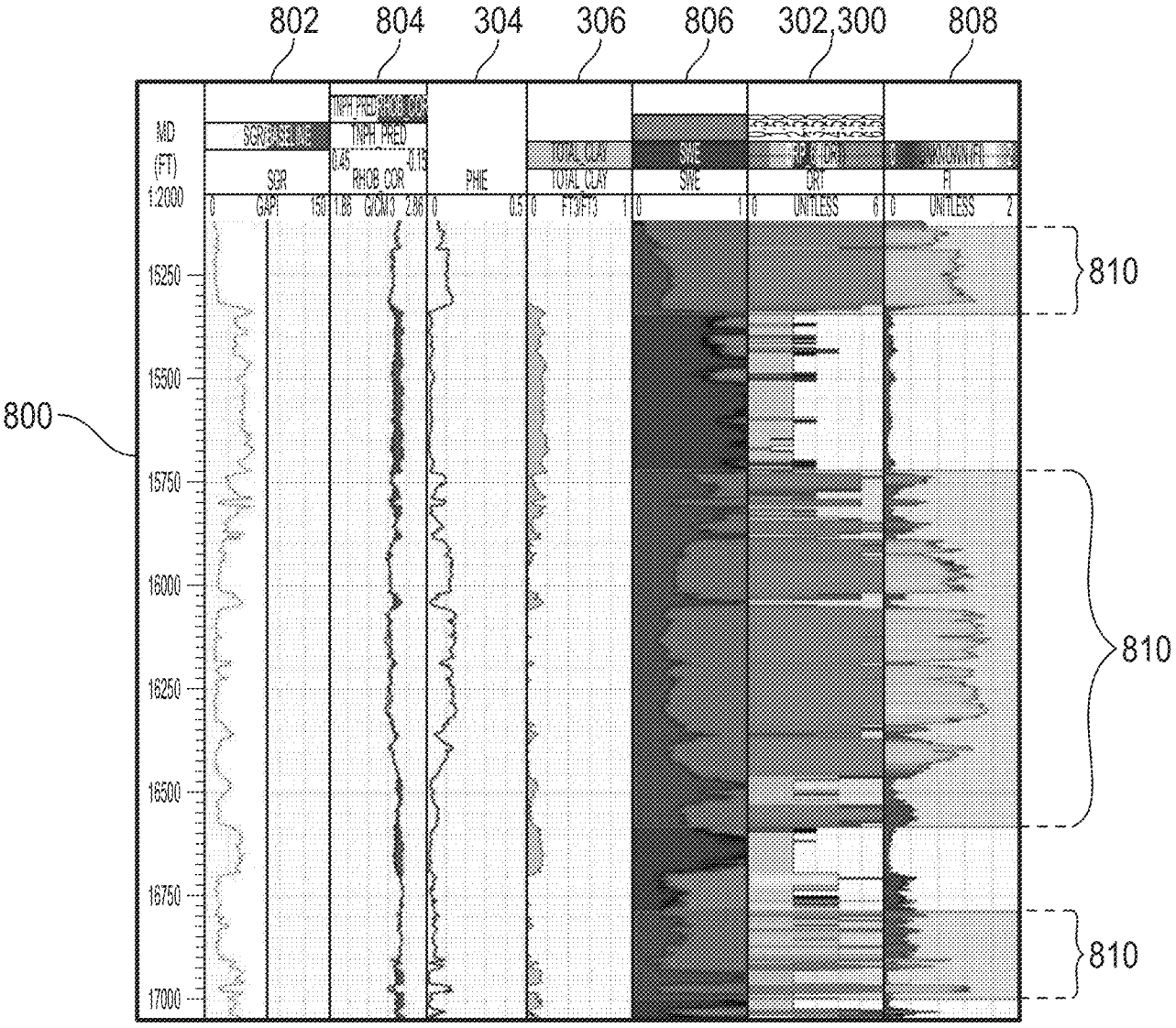
FIGS. 7 and 8 show example data in accordance with one or more embodiments.
Figure 8:
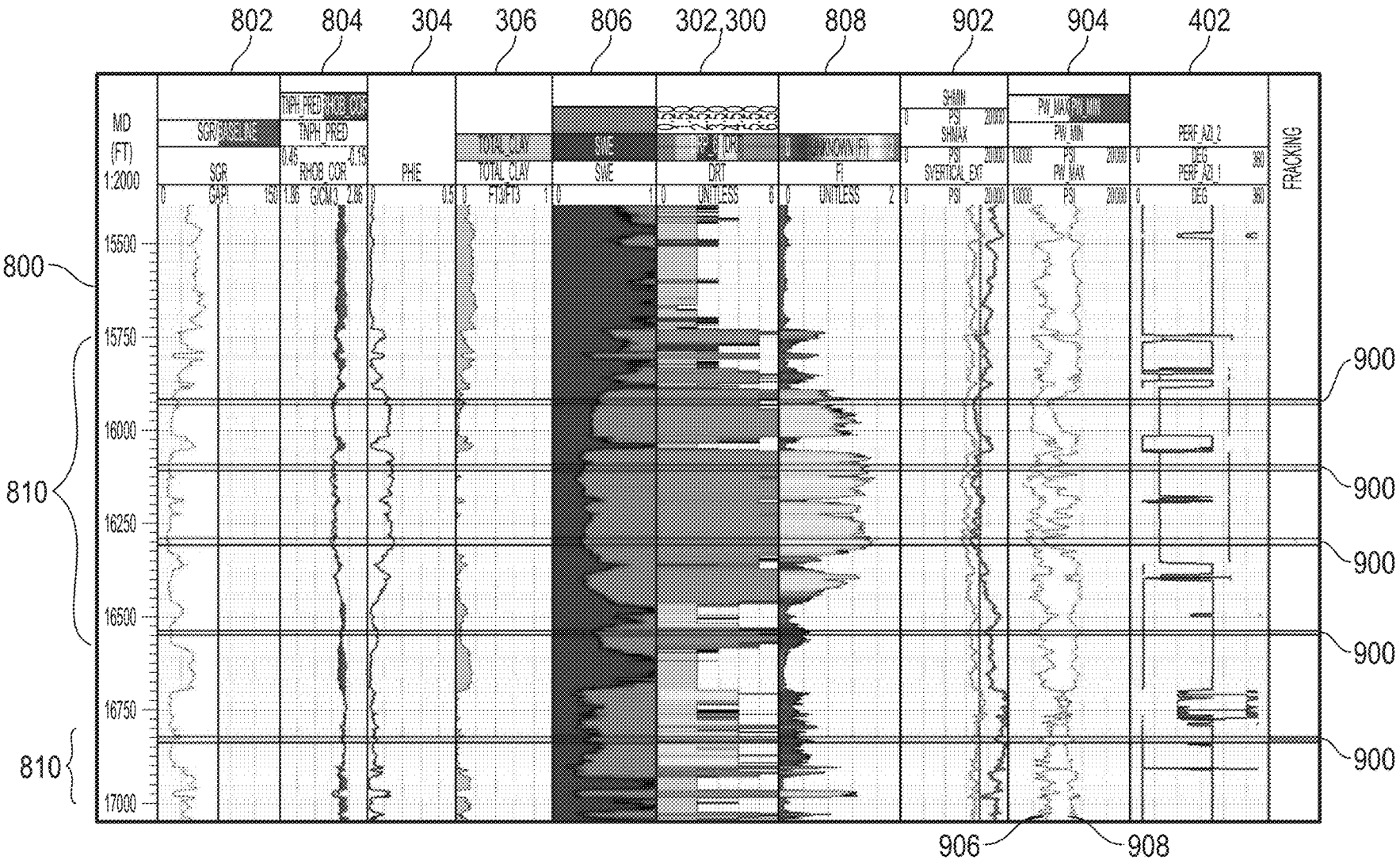

FIGS. 7 and 8 show example data about the well (102, 104) and the reservoir (105) in accordance with one or more embodiments. FIGS. 7 and 8 are for example purposes only and are not meant to be limiting. Specifically, FIG. 7 shows an example data set being used to determine the first set of perforation locations (810). FIG. 8 builds on FIG. 7 and shows secondary determinations of the example data set that may be used to determine the second set of perforation locations (900). The example data set shown in FIGS. 7 and 8 may be called a log without departing from the scope of the disclosure herein.

FIG. 7 shows measured depth (800) on the vertical axis and seven different types of data along the horizontal axis. The seven types of data shown are spectral gamma rays (802), bulk density (804), effective porosity (304), total clay content (306), effective water saturation (806), diagenetic rock type codes (302)/diagenetic rock types (300), and flow indexes (808) of the reservoir (105) at the various measured depths (800). FIG. 8 also highlights the measured depths (800) that may be selected for the first set of perforation locations (810) due to having high diagenetic rock type codes (302) (i.e., low numbered diagenetic rock types (300)) and high flow indexes (808).

The well log shown in FIG. 7 may be created by gathering raw data using well logging tools, such as gamma ray tools. In accordance with one or more embodiments, the computer (702) may gather and use the raw data to determine calculated data, such as the diagenetic rock type codes (302)/diagenetic rock types (300) and the flow indexes (808). A user or an algorithm programmed into the computer processor (705) may analyze diagenetic rock type codes (302)/diagenetic rock types (300) and the flow indexes (808) along the measured depth (800) of the reservoir (105) to determine the first set of perforation locations (810) as outlined above in S202-S204.

FIG. 8 shows a continuation of the log shown in FIG. 7 with three types of data added to the seven data types shown in FIG. 7. That is, FIG. 8 shows measured depth (800) along the vertical axis and spectral gamma rays (802), bulk density (804), effective porosity (304), total clay content (306), effective water saturation (806), diagenetic rock type codes (302)/diagenetic rock types (300), flow indexes (808), in-situ stresses (902), breakdown pressure envelopes (904), and perforation direction (perforation azimuth) (402) along the vertical axis.

FIG. 8 shows the second set of perforation locations (900) selected at various measured depths (800) located within the first set of perforation locations (810). The selected second set of perforation locations (900) are the measured depths (800) that have relatively low breakdown pressure envelopes (904). FIG. 8 also shows the lower boundary (906) and the upper boundary (908) of the breakdown pressure envelopes (904). As outlined above in S209-S210, the computer processor (705) may calibrate the in-situ stresses (902) to the measured depths first (800) and determine the breakdown pressure envelope (904) by calculating the lower boundaries (906) and the upper boundaries (908) at the measured depths (800) based on the in-situ stresses (902), reservoir pressure, formation geomechanical properties, and well trajectory.

Figure 9:
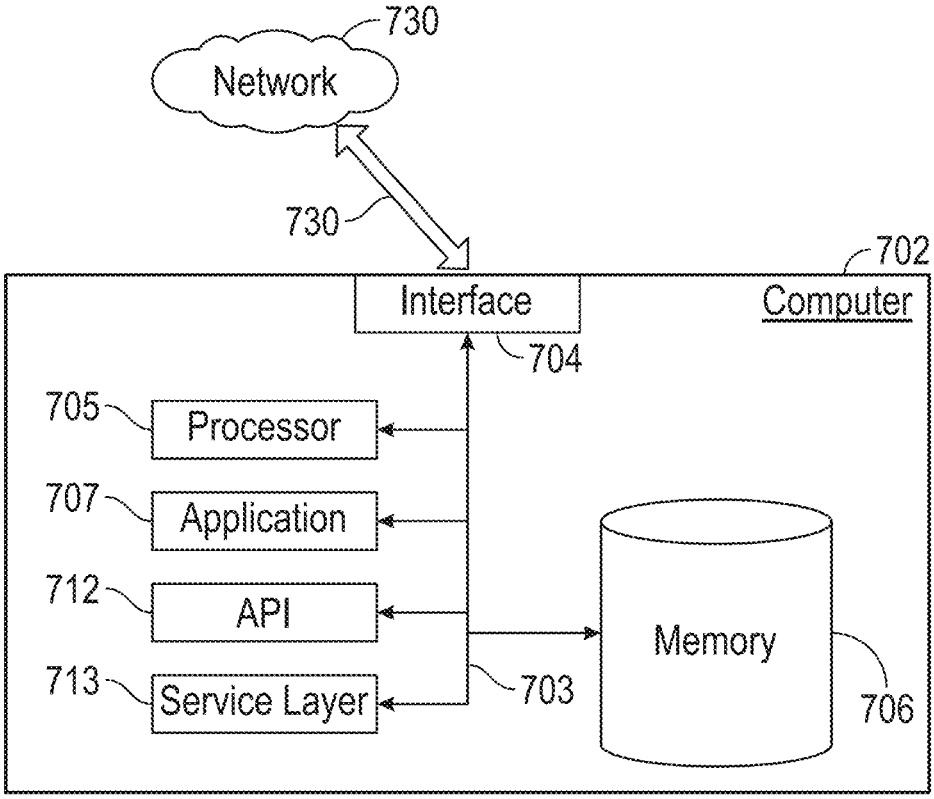
FIG. 9 shows a computer system in accordance with one or more embodiments.

FIG. 9 shows a computer (702) system in accordance with one or more embodiments. Specifically, FIG. 9 shows a block diagram of a computer (702) system used to provide computational functionalities associated with described algorithms, methods, functions, processes, flows, and procedures as described in the instant disclosure, according to an implementation. The illustrated computer (702) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730). In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) from a client application (for example, executing on another computer (702)) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702).

The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or other suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 9, two or more interfaces (704) may be used according to particular needs, desires, or particular implementations of the computer (702). The interface (704) is used by the computer (702) for communicating with other systems in a distributed environment that are connected to the network (730). Generally, the interface (704) includes logic encoded in software or hardware (or a combination of software and hardware) and operable to communicate with the network (730). More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 9, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a non-transitory computer (702) readable medium, or a memory (706), that holds data for the computer (702) or other components (or a combination of both) that can be connected to the network (730). For example, memory (706) can be a database storing data consistent with this disclosure. Although illustrated as a single memory (706) in FIG. 9, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), each computer (702) communicating over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for fracturing a well drilled through a deep and tight sandstone reservoir and having a wellhead, the method comprising:

gathering, using a computer processor, data about the well and the deep and tight sandstone reservoir;

evaluating, using the computer processor, a diagenetic rock typing and a flow index of the deep and tight sandstone reservoir using the data;

determining, using the computer processor, a first set of perforation locations based on the diagenetic rock typing and the flow index;

calibrating, using the computer processor, in-situ stresses based on the data;

determining, using the computer processor, a breakdown pressure envelope and optimal perforation directions using the in-situ stresses, maximum horizontal stress direction, formation mechanical properties, and well trajectory;

narrowing, using the computer processor, the first set of perforation locations to a second set of perforation locations based on the breakdown pressure envelope;

comparing, using the computer processor, the breakdown pressure envelope of the second set of perforation locations to a maximum downhole pressure the wellhead can safely provide to determine a perforation method, wherein the maximum downhole pressure the wellhead can safely provide is based on a safety limit capacity of the wellhead; and performing a fracturing operation on the well using the second set of perforation locations, the perforation method and the optimal perforation directions.

2. The method of claim 1, wherein determining a first set of perforation locations based on the diagenetic rock typing and the flow index further comprises selecting one or more locations along the well that comprise cleaner sand, lower clay content, higher porosity, and higher hydrocarbon saturation when compared to other locations along the well.

3. The method of claim 1, wherein narrowing the first set of perforation locations to the second set of perforation locations based on the breakdown pressure envelope further comprises selecting one or more perforation locations, from the first set of perforation locations, that comprise a lower breakdown pressure when compared to other perforation locations from the first set of perforation locations.

4. The method of claim 1, wherein determining the perforation method further comprises selecting a conventional perforation method when a lower boundary of the breakdown pressure envelope of the second set of perforation locations is less than 85 percent of the maximum downhole pressure the wellhead can safely provide.

5. The method of claim 1, wherein determining the perforation method further comprises selecting an oriented perforation method when a lower boundary of the breakdown pressure envelope of the second set of perforation locations is more than 85 percent of the maximum downhole pressure the wellhead can safely provide.

6. The method of claim 1, wherein calibrating the in-situ stresses further comprises image log processing the data to determine breakouts, natural fractures, and maximum horizontal stress direction.

7. The method of claim 1, wherein calibrating the in-situ stresses further comprises calculating geomechanical properties using the data.

8. The method of claim 1, wherein evaluating the diagenetic rock typing and the flow index further comprises using sandstone petrophysical evaluation results.

9. The method of claim 1, wherein determining the breakdown pressure envelope further comprises determining a lowest and a highest breakdown pressure at each measured depth along the deep and tight sandstone reservoir.

10. The method of claim 9, wherein the lowest breakdown pressure at each measured depth corresponds to optimum perforation directions.

11. A system comprising:

a hydraulic fracturing system for a well drilled through a deep and tight sandstone reservoir and having a wellhead, wherein the hydraulic fracturing system comprises perforating and pumping equipment and is configured to perform a hydraulic fracturing operation using a perforating gun to perforate the well and a frac fluid pumped to fracture the deep and tight sandstone reservoir and a computer processor configured to:

gather data about the well and the deep and tight sandstone reservoir;

evaluate a diagenetic rock typing and a flow index of the deep and tight sandstone reservoir using the data;

determine a first set of perforation locations based on the diagenetic rock typing and the flow index;

calibrate in-situ stresses based on the data;

determine a breakdown pressure envelope and optimal perforation directions using the in-situ stresses, maximum horizontal stress direction, formation mechanical properties, and well trajectory;

narrow the first set of perforation locations to a second set of perforation locations based on the breakdown pressure envelope;

compare the breakdown pressure envelope of the second set of perforation locations to a maximum downhole pressure the wellhead can safely provide to determine a perforation method, wherein the maximum downhole pressure the wellhead can safely provide is based on a safety limit capacity of the wellhead; and initiate a fracturing operation on the well using the second set of perforation locations, the perforation method and the optimal perforation directions.

12. The system of claim 11, wherein determining a first set of perforation locations based on the diagenetic rock typing and the flow index further comprises selecting one or more locations along the well that comprise cleaner sand, lower clay content, higher porosity, and higher hydrocarbon saturation when compared to other locations along the well.

13. The system of claim 11, wherein narrowing the first set of perforation locations to the second set of perforation locations based on the breakdown pressure envelope further comprises selecting one or more perforation locations, from the first set of perforation locations, that comprise a lower breakdown pressure when compared to other perforation locations from the first set of perforation locations.

14. The system of claim 11, wherein determining the perforation method further comprises selecting a conventional perforation method when a lower boundary of the breakdown pressure envelope of the second set of perforation locations is less than 85 percent of the maximum downhole pressure the wellhead can safely provide.

15. The system of claim 11, wherein determining the perforation method further comprises selecting an oriented perforation method when a lower boundary of the breakdown pressure envelope of the second set of perforation locations is more than 85 percent of the maximum downhole pressure the wellhead can safely provide.

16. The system of claim 11, wherein calibrating the in-situ stresses further comprises image log processing the data to determine breakouts, natural fractures, and maximum horizontal stress direction.

17. The system of claim 11, wherein calibrating the in-situ stresses further comprises calculating geomechanical properties using the data.

18. The system of claim 11, wherein evaluating the diagenetic rock typing and the flow index further comprises using sandstone petrophysical evaluation results.

19. The system of claim 11, wherein determining the breakdown pressure envelope further comprises determining a lowest and a highest breakdown pressure at each measured depth along the deep and tight sandstone reservoir.

20. The system of claim 19, wherein the lowest breakdown pressure at each measured depth corresponds to optimal perforation directions.

* * * * *